US011466518B2

(12) United States Patent
Voglewede et al.

(10) Patent No.: US 11,466,518 B2
(45) Date of Patent: Oct. 11, 2022

(54) DRILL BIT WITH REINFORCED BINDER ZONES

(71) Applicant: Halliburton Energy Services, Inc., Houston, TX (US)

(72) Inventors: Brendan Voglewede, Spring, TX (US); Grant O. Cook, III, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1199 days.

(21) Appl. No.: 15/570,426

(22) PCT Filed: Jun. 11, 2015

(86) PCT No.: PCT/US2015/035327
§ 371 (c)(1),
(2) Date: Oct. 30, 2017

(87) PCT Pub. No.: WO2016/200389
PCT Pub. Date: Dec. 15, 2016

(65) Prior Publication Data

US 2018/0142521 A1 May 24, 2018

(51) Int. Cl.

| | |
|---|---|
| ***E21B 10/42*** | (2006.01) |
| ***C22C 1/05*** | (2006.01) |
| ***C22C 29/00*** | (2006.01) |
| ***C22C 29/06*** | (2006.01) |
| *B22F 5/00* | (2006.01) |

(52) U.S. Cl.
CPC ..... *E21B 10/42* (2013.01); *C22C 1/051* (2013.01); *C22C 29/005* (2013.01); *C22C 29/067* (2013.01); *B22F 2005/001* (2013.01)

(58) Field of Classification Search
CPC ..... E21B 10/42; E21B 10/46; E21B 10/62; C22C 1/051; C22C 29/005; C22C 29/067; B22F 2005/001
See application file for complete search history.

(56) References Cited

U.S. PATENT DOCUMENTS 10,208,366 B2 * 2/2019 Olsen ..... E21B 10/46
2007/0175669 A1 8/2007 Liang et al.
(Continued)

FOREIGN PATENT DOCUMENTS

WO 2016/140677 A1 9/2016

OTHER PUBLICATIONS

International Preliminary Report on Patentability issued in related PCT Application No. PCTUS2015/035327, dated Dec. 21, 2017, 10 pages.

(Continued)

*Primary Examiner* — Rebecca Janssen
(74) *Attorney, Agent, or Firm* — Thomas Rooney; C. Tumey Law Group PLLC

(57) ABSTRACT

A drill bit having reinforced binder zones and method of forming same are disclosed. The method includes the steps of mixing reinforcing particles with a binder-reinforcing material, placing the mixture of reinforcing particles and binder-reinforcing material in a mold used in forming a body of the drill bit, placing a universal binder in the mold, and heating the mold. The binder-reinforcing material is infiltrated with the universal binder which thereby forms reinforced binder zones.

20 Claims, 5 Drawing Sheets

(56) References Cited

U.S. PATENT DOCUMENTS

| | | | | |
|---|---|---|---|---|
| 2008/0210473 | A1 | 9/2008 | Zhang et al. | |
| 2008/0282618 | A1 | 11/2008 | Lockwood | |
| 2010/0230173 | A1 | 9/2010 | Xia et al. | |
| 2013/0180786 | A1* | 7/2013 | Thomas | E21B 17/1085 175/434 |
| 2016/0265284 | A1 | 9/2016 | Voglewede et al. | |

OTHER PUBLICATIONS

International Search Report and Written Opinion issued in related PCT Application No. PCT/US2015/035327 dated Mar. 9, 2016, 13 pages.

* cited by examiner

DRILL BIT WITH REINFORCED BINDER ZONES

CROSS-REFERENCE TO RELATED APPLICATION

The present application is a U.S. National Stage Application of International Application No. PCT/US2015/035327 filed Jun. 11, 2015, which is incorporated herein by reference in its entirety for all purposes.

TECHNICAL FIELD

The present disclosure relates generally to drilling tools, such as earth-boring drill bits, and more particularly, to metal-matrix composite (MMC) drill bits having reinforced binder zones.

BACKGROUND

Various types of drilling tools including, but not limited to, rotary drill bits, reamers, core bits, under reamers, hole openers, stabilizers, and other downhole tools are used to form wellbores in downhole formations. Examples of rotary drill bits include, but are not limited to, fixed-cutter drill bits, drag bits, polycrystalline diamond compact (PDC) drill bits, matrix drill bits, and hybrid bits associated with forming oil and gas wells extending through one or more downhole formations.

Matrix drill bits are typically formed by placing loose reinforcing particles such as tungsten carbide, typically in powder form, into a mold and infiltrating the reinforcing particles with a binder material such as a copper alloy. The reinforcing particles infiltrated with a molten metal alloy or binder material may form a matrix bit body after solidification of the binder material with the reinforcing particles. Hybrid bits containing matrix drill bit features may be formed in a similar manner.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

During a subterranean operation, various downhole tools, including drill bits, coring bits, reamers, and/or hole enlargers, may be lowered in a wellbore and may be formed of a metal-matrix composite (MMC).

According to various system and methods disclosed herein, the materials used to form the MMC may include binder-reinforcing material, incorporated during manufacturing, which may be configured to provide reinforced binder pools throughout the body of the drill bit or in selected regions of the downhole tool such that the properties of the selected regions are optimized for the conditions experienced by the selected regions during the subterranean operation. The localized reinforced binder zones may be selected to provide localized properties based on the detrimental conditions that exist in the region of the downhole tool and/or the function of the region of the downhole tool during a subterranean operation. The binder material in the disclosed bits results in a more efficient packing of materials that may desirably avoid the formation of pools or zones within the areas of reinforcements. These regions have a reduced tendency to undergo preferential erosion or wear compared to corresponding areas of a conventional bit body not reinforced as disclosed herein with the tungsten carbide or other reinforcing material.

Figure 1:
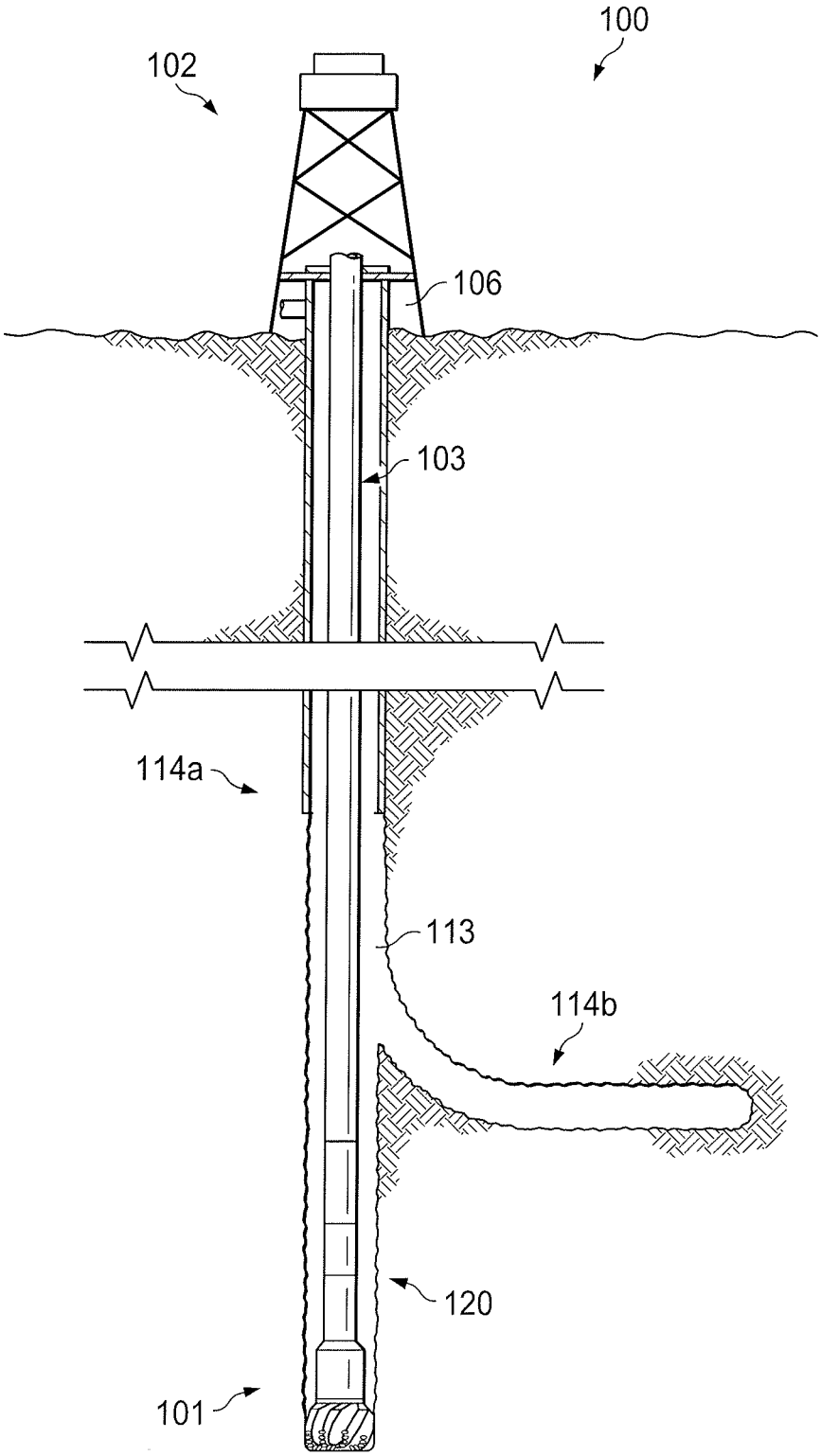
FIG. 1 is an elevation view of a drilling system.

The present disclosure and its advantages are best understood by referring to FIGS. 1 through 5, where like numbers are used to indicate like and corresponding parts. FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom-hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater than normal variations associated with vertical wellbores. Direction drilling may include horizontal drilling.

Drilling system 100 may also include rotary drill bit (drill bit) 101. Drill bit 101, discussed in further detail in FIG. 2, may be an MMC drill bit which may be formed by placing loose reinforcement particles/material including tungsten carbide powder, into a mold and infiltrating the reinforcing particles with a universal binder material including a copper alloy and/or an aluminum alloy. In accordance with one aspect of the present disclosure, the amount of loose reinforcing particles added, which can be fairly expensive, may be reduced by instead reinforcing the binder-rich zones with a special type of binder (different than the infiltrating binder). This binder-reinforcing material may comprise a metal, alloy, intermetallic, ceramic or any combination thereof. The mold may be formed by milling a block of material, such as graphite, to define a mold cavity having features that correspond generally with the exterior features of drill bit 101.

Drill bit 101 may include one or more blades 126 that may be disposed outwardly from exterior portions of rotary bit body 124 of drill bit 101. Rotary bit body 124 may be generally cylindrical and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

In some embodiments, during the mold loading process, a reinforcing material may be used to reinforce the drill bit 101. The reinforcing material may optimize the integrity of the drill bit 101 at the micro level for the conditions experienced by the drill bit during the subterranean drilling operation. A binder-reinforcing material may also be used to reinforce the binder zones that are formed. The binder-reinforcing material may be placed in a variety of configurations based on the selected localized properties for the regions of drill bit 101 in which the binder-reinforcing material is placed, as described in more detail with reference to FIG. 5. The reinforcing particles and the localized binder-reinforcing material may be infiltrated with a molten universal binder material to form bit body 124 after solidification of the universal binder material and the localized binder-reinforcing material.

Figure 2:
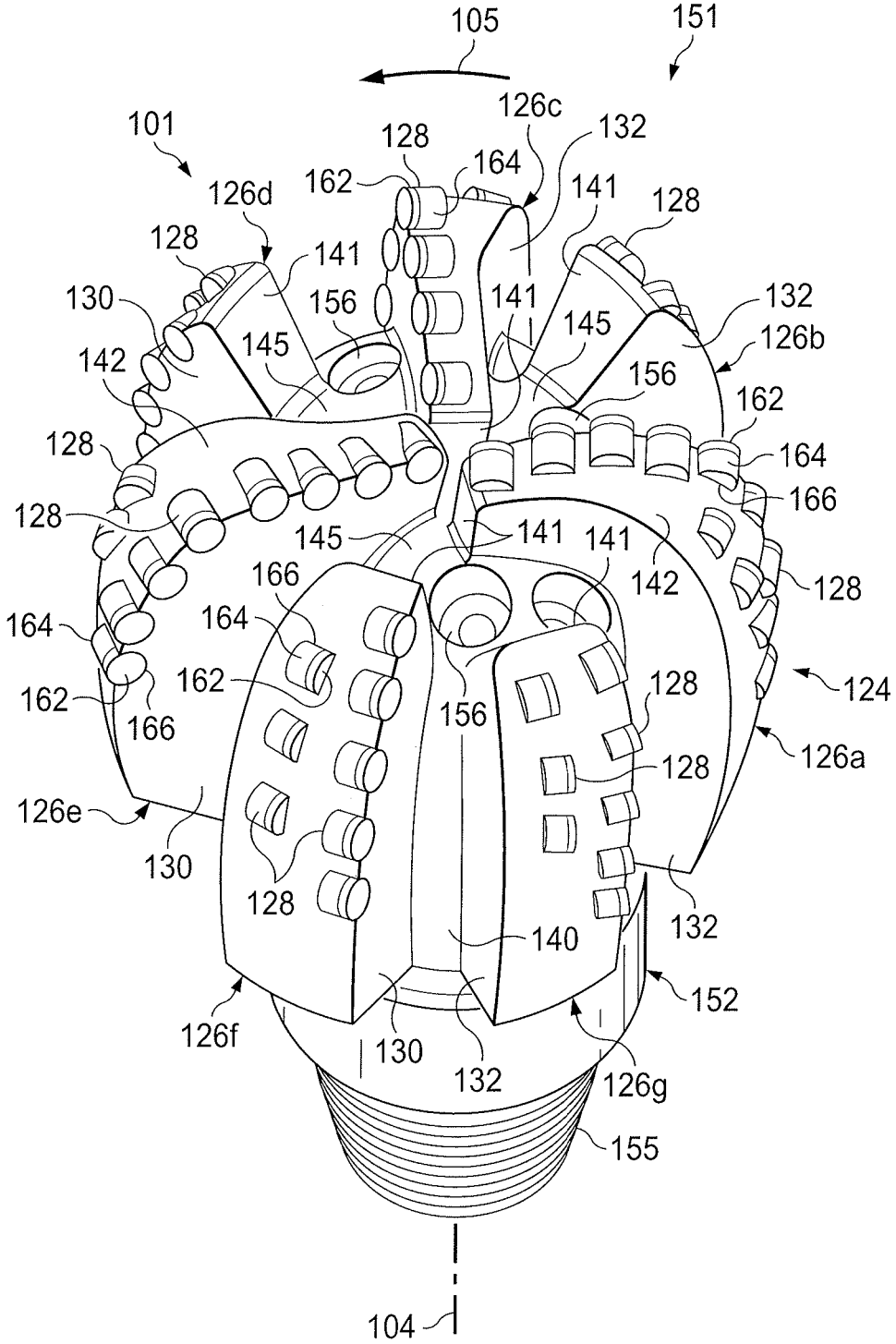
FIG. 2 is an isometric view of a rotary drill bit oriented upwardly in a manner often used to model or design fixed-cutter drill bits.

FIG. 2 is an isometric view of a rotary drill bit oriented upwardly in a manner often used to model or design fixed-cutter drill bits. To the extent that at least a portion of the drill bit is formed of an MMC, the drill bit may be any of various types of fixed-cutter drill bits, including PDC bits, drag bits, matrix-body drill bits, steel-body drill bits, hybrid drill bits, and/or combination drill bits including fixed cutters and roller-cone bits operable to form wellbore 114 (as illustrated in FIG. 1) extending through one or more downhole formations. Drill bit 101 may be designed and formed in accordance with teachings of the present disclosure and may have many different designs, configurations, and/or dimensions according to the particular application of drill bit 101.

During a subterranean operation, different regions of drill bit 101 may be exposed to different forces and/or stresses. Therefore, during manufacturing of drill bit 101, the properties of drill bit 101 may be customized such that some regions of drill bit 101 may have different properties from other regions of drill bit 101. The localized properties may be achieved by placing a binder-reinforcing material in selected locations and in selected configurations in a mold for drill bit 101. The type, location, and/or configuration of the localized binder-reinforcing material may be selected to provide localized properties for drill bit 101 based on the downhole conditions experienced by the region of drill bit 101 and/or the function of the region of drill bit 101.

Drill bit 101 may be an MMC drill bit which may be formed by placing loose reinforcement particles, including tungsten carbide powder, into a mold and infiltrating the reinforcing particles with a universal binder material, which may be a copper alloy. The drill bit 101 may also have selected/localized areas of reinforced binder zones, especially in those areas subject to high stress. The reinforced binder zones contain at least two materials that form a refractory intermetallic phase, which is an intermetallic phase with a higher melting point than either the molten binder temperature or the furnace processing temperature. The first of the at least two materials may comprise copper, nickel, cobalt, iron, aluminum, molybdenum, chromium, manganese, tin, zinc, lead, silicon, tungsten, boron, phosphorous, gold, silver, palladium, indium, and/or alloys or a combination thereof. The second of the at least two materials may comprise any element that forms an intermetallic with the first material. The intermetallic particles may be formed via diffusion, chemical reaction in-situ or after solidification. These particles may be located in, along, or near the grain boundaries of the universal binder. Further details of the reinforced binder zones in accordance with the present disclosure are provided below.

The mold may be formed by milling a block of material, such as graphite, to define a mold cavity having features that correspond generally with the exterior features of drill bit 101. Various features of drill bit 101 including blades 126, cutter pockets 166, and/or fluid flow passageways may be provided by shaping the mold cavity and/or by positioning temporary displacement materials within interior portions of the mold cavity. A preformed steel shank or bit mandrel (sometimes referred to as a blank) may be placed within the mold cavity to provide reinforcement for bit body 124 and to allow attachment of drill bit 101 with a drill string and/or BHA. A quantity of reinforcement particles and binder-reinforcing material may be placed within the mold cavity and infiltrated with a molten universal binder material to form bit body 124 after solidification of the universal binder material with the reinforcement particles and binder-reinforcing material.

Drill bit 101 may include shank 152 with drill pipe threads 155 formed thereon. Threads 155 may be used to releasably engage drill bit 101 with a bottom-hole assembly (BHA), such as BHA 120, shown in FIG. 1, whereby drill bit 101 may be rotated relative to bit rotational axis 104. Plurality of blades **126*a*-126*g* may have respective junk slots or fluid flow paths 140 disposed there between. Due to erosion during a subterranean operation, drill bit 101 may have the binder-reinforcing material placed near junk slots 140 to provide erosion resistance. The binder-reinforcing material may be selected to reduce the surface energy in junk slots 140 to provide optimized fluid flow through junk slots 140**.

Drilling fluids may be communicated to one or more nozzles 156. The regions of drill bit 101 near nozzle 156 may be subject to stresses during the subterranean operation that may cause cracks in drill bit 101. A binder-reinforcing material may be added near nozzles 156 to increase the strength of resilience and provide crack-arresting properties near nozzles 156 of drill bit 101. The localized binder-reinforcing material may be selected to reduce the surface energy near nozzles 156 to provide optimized flow of drilling fluids through nozzles 156.

Drill bit 101 may include one or more blades **126*a*-126*g*, collectively referred to as blades 126, which may be disposed outwardly from exterior portions of rotary bit body 124. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126** formed in accordance with the teachings of the present disclosure may have a wide variety of configurations including, but not limited to, substantially arched, helical, spiraling, tapered, converging, diverging, symmetrical, and/or asymmetrical.

Each of blades 126 may include a first end disposed proximate or toward bit rotational axis 104 and a second end disposed proximate or toward exterior portions of drill bit 101 (i.e., disposed generally away from bit rotational axis 104 and toward up-hole portions of drill bit 101). Blades 126 may have apex 142 that may correspond to the portion of blade 126 furthest from bit body 124 and blades 126 may join bit body 124 at landing 145. Apex 142 and landing 145 may be subjected to stresses during a subterranean operation that may cause cracks in apex 142 and landing 145. Therefore, the binder-reinforcing material according to the present disclosure may be added near apex 142 and landing 145 to increase the strength or resilience and provide crack-arresting properties at apex 142 and landing 145.

In some cases, blades 126 may have substantially arched configurations, generally helical configurations, spiral shaped configurations, or any other configuration satisfactory for use with each drilling tool. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit. The outer surface of blades 126 may be subjected to high stresses during a subterranean operation which may cause cracks to form along the outer surface of blades 126. The binder-reinforcing material according to the present disclosure may be added near the outer surface of blades 126 to increase the strength or resilience and provide crack arresting properties at the outer surface of blades 126.

Blades 126 may have a general arcuate configuration extending radially from rotational axis 104. The arcuate configurations of blades 126 may cooperate with each other to define, in part, a generally cone shaped or recessed portion disposed adjacent to and extending radially outward from the bit rotational axis. Exterior portions of blades 126, cutting elements 128 and other suitable elements may be described as forming portions of the bit face.

Blades 126*a*-126*g* may include primary blades disposed about bit rotational axis 104. For example, in FIG. 2, blades 126*a*, 126*c*, and 126*e* may be primary blades or major blades because respective first ends 141 of each of blades 126*a*, 126*c*, and 126*e* may be disposed closely adjacent to associated bit rotational axis 104. In some configurations, blades 126*a*-126*g* may also include at least one secondary blade disposed between the primary blades. Blades 126*b*, 126*d*, 126*f*, and 126*g* shown in FIG. 2 on drill bit 101 may be secondary blades or minor blades because respective first ends 141 may be disposed on downhole end 151 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the disposition may be based on the downhole drilling conditions of the drilling environment. In some cases, blades 126 and drill bit 101 may rotate about rotational axis 104 in a direction defined by directional arrow 105.

Each blade may have a leading (or front) surface 130 disposed on one side of the blade in the direction of rotation of drill bit 101 and a trailing (or back) surface 132 disposed on an opposite side of the blade away from the direction of rotation of drill bit 101. The leading surface 130 may be subject to erosion during the subterranean operation. The binder-reinforcing material according to the present disclosure may be used near the region of leading surfaces 130 of blades 126 to increase the crack-arresting properties, erosion-resistance, and stiffness of leading surfaces 130. Blades 126 may be positioned along bit body 124 such that they have a spiral configuration relative to rotational axis 104. In other configurations, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. Cutting elements 128 may be any suitable device configured to cut into a formation, including but not limited to, primary cutting elements, back-up cutting elements, secondary cutting elements, or any combination thereof. By way of example and not limitation, cutting elements 128 may be various types of cutters, compacts, buttons, inserts, and gage cutters satisfactory for use with a wide variety of drill bits 101.

Cutting elements 128 may include respective substrates with a layer of hard cutting material, including cutting table 162, disposed on one end of each respective substrate, including substrate 164. Blades 126 may include recesses or cutter pockets 166 that may be configured to receive cutting elements 128. For example, cutter pockets 166 may be concave cutouts on blades 126. Cutter pockets 166 may be subject to impact forces during the subterranean operation. Therefore, a localized binder material may be used to provide impact toughness to cutter pockets 166. Additionally, localized binder material may be used to increase the surface energy of cutter pockets 166 to assist in increasing bonding adhesion. Further, localized binder material may be used to produce rougher surfaces in cutter pockets 166, providing mechanical interlocking during the brazing process when cutting elements 128 are coupled to cutter pockets 166.

Blades 126 may further include one or more gage pads (not expressly shown) disposed on blades 126. A gage pad may be a gage, gage segment, or gage portion disposed on exterior portion of blade 126. Gage pads may often contact adjacent portions of wellbore 114 formed by drill bit 101. Exterior portions of blades 126 and/or associated gage pads may be disposed at various angles, positive, negative, and/or parallel, relative to adjacent portions of generally vertical portions of wellbore 114. A gage pad may include one or more layers of hard-facing material.

Figure 3:
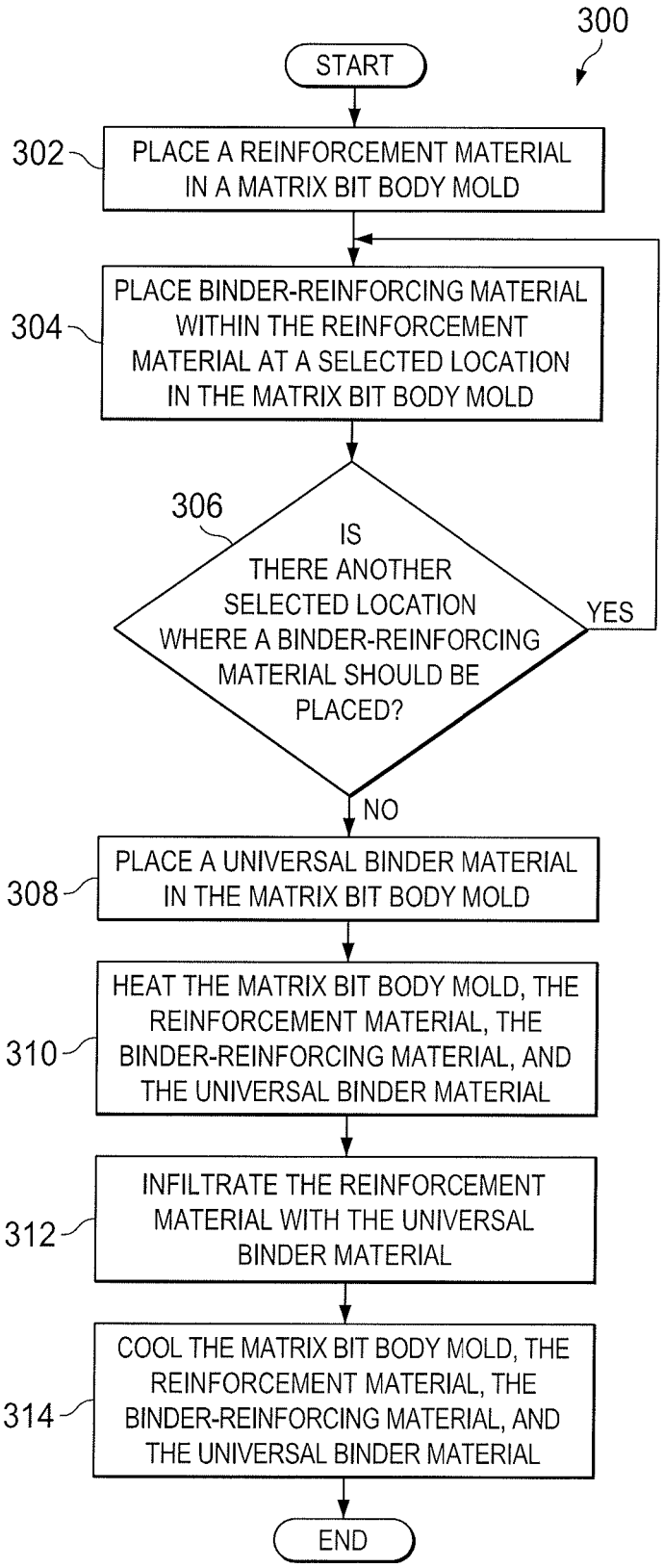
FIG. 3 is a flow chart of an example method of forming an MMC drill bit according to the present disclosure.

Drill bits, such as drill bit 101, may be formed using a mold assembly. FIG. 3 is a flow chart of an example method of forming a metal-matrix composite drill bit having reinforced binder zone properties. The steps of method 300 may be performed by a person or manufacturing device (referred to as a manufacturer) that is configured to fill molds used to form MMC drill bits.

Method 300 may begin at step 302 (or alternatively at step 304 described below) where the manufacturer may place reinforcement particles, such as a tungsten carbide powder, e.g., and binder-reinforcing material in a matrix bit body mold. The reinforcement particles and binder-reinforcing material may be blended prior to being placed into the bit body mold. Alternatively, binder-reinforcing material may be placed in layers in localized regions of the bit body needing greater toughness, erosion resistance and other preferential properties. The matrix bit body mold may be similar to the molds described with respect to FIG. 5.

The reinforcement particles/material may be selected to provide designed characteristics for the resulting drill bit, such as fracture resistance, toughness, and/or erosion, abrasion, and wear resistance. The reinforcing particles may be any suitable material, such as, but are not limited to, particles of metals, metal alloys, super alloys, intermetallics, borides, carbides, nitrides, oxides, silicides, ceramics, diamonds, and the like, or any combination thereof. More particularly, examples of reinforcing particles suitable for use in conjunction with the embodiments described herein may include particles that include, but are not limited to, tungsten, molybdenum, niobium, tantalum, rhenium, iridium, ruthenium, beryllium, titanium, chromium, rhodium, iron, cobalt, nickel, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, cobalt alloys, chromium alloys, HASTELLOY® alloys (e.g., nickel-chromium containing alloys, available from Haynes International), INCONEL® alloys (e.g., austenitic nickel-chromium containing super alloys available from Special Metals Corporation), WASPALOYS® (e.g., austenitic nickel-based super alloys), RENE® alloys (e.g., nickel-chromium containing alloys available from Altemp Alloys, Inc.), HAYNES® alloys (e.g., nickel-chromium containing super alloys available from Haynes International), INCOLOY® alloys (e.g., iron-nickel containing super alloys available from Mega Mex), MP98T (e.g., a nickel-copper-chromium super alloy available from SPS Technologies), TMS alloys, CMSX® alloys (e.g., nickel-based super alloys available from C-M Group), cobalt alloy 6B (e.g., cobalt-based super alloy available from HPA), N-155 alloys, any mixture thereof, and any combination thereof. In some embodiments, the reinforcing particles may be coated. In some cases, multiple types of reinforcing particles may be used to form a single resulting drill bit.

The binder-reinforcing material may comprise a metal, alloy, intermetallic, ceramic, or any combination thereof. Further details of the binder-reinforcing material are provided below.

At step 304, the manufacturer may optionally place the binder-reinforcing material among the reinforcing particles at selected locations within the matrix bit body mold. The binder-reinforcing material may be layered and/or mixed with the reinforcement particles. The placement of the binder-reinforcing material in select locations may provide localized properties, as described in further detail with respect to FIG. 5. The type of localized binder-reinforcing material may be selected based on the diffusion characteristics of the material. For example, some materials may provide a slower, more focused diffusion rate, which may be more appropriate for use in localized areas while other materials may provide a faster diffusion rate and may diffuse over a larger area which may be more appropriate for use in larger areas. The packing of the reinforcing particle may be adjusted to aid in controlling the diffusion rate.

Figure 5:
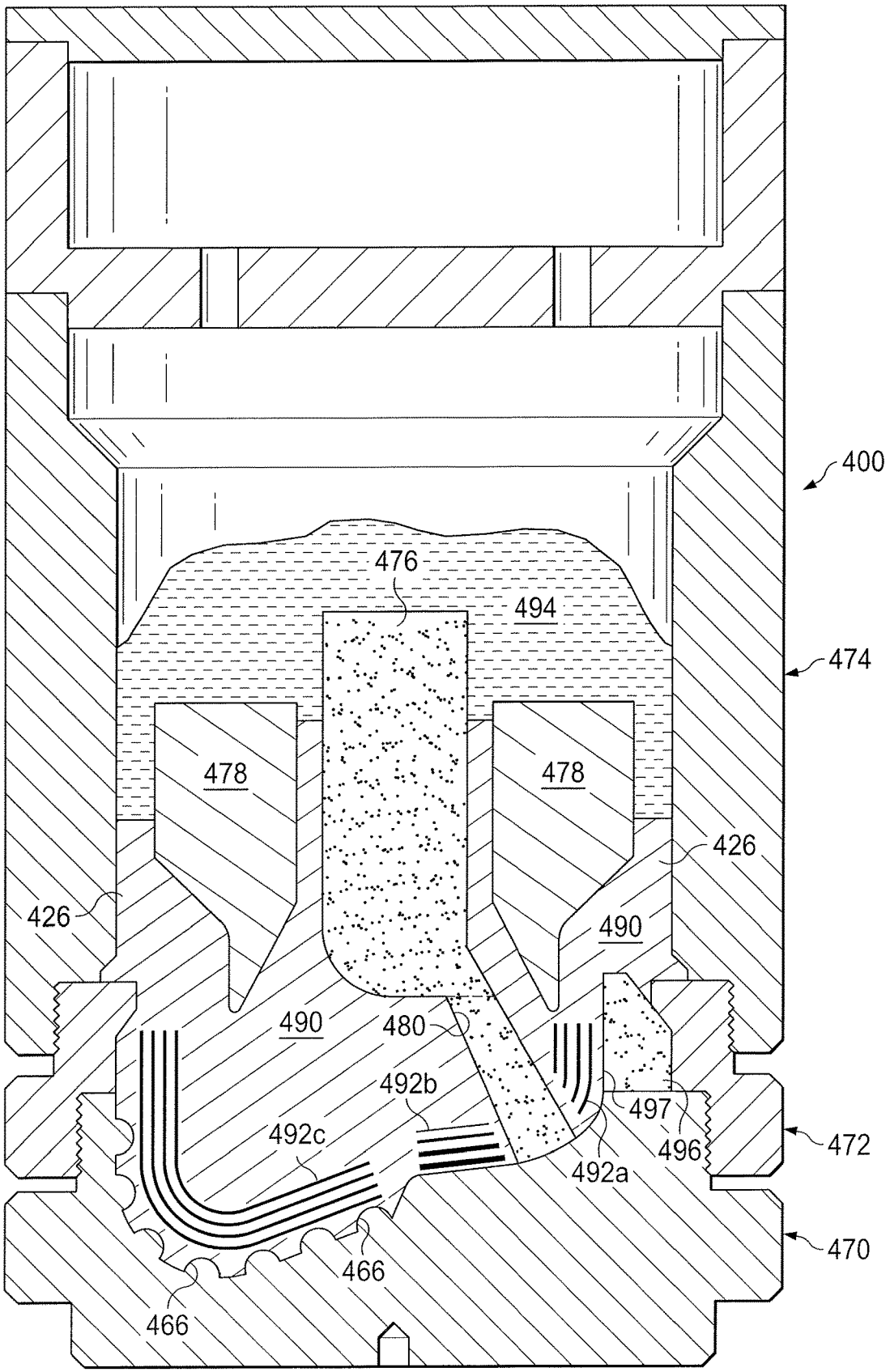
FIG. 5 is a schematic drawing in section with portions broken away showing an example of a mold assembly with layers of a localized binder-reinforcing material positioned near an outer surface of a blade and an apex of a metal-matrix composite (MMC) drill bit.

The binder-reinforcing material may have various sizes and shapes according to the selected localized properties and/or the selected diffusion rates of binder-reinforcing material, with one exemplary embodiment being described in further detail with respect to FIG. 5. The binder-reinforcing material may be placed in a variety of configurations, based on the selected properties and/or the size of the region over which the localized properties are to be spread.

At step 306, the manufacturer may optionally determine whether there is another selected location where the binder-reinforcing material should be placed. If there is another selected location where the binder-reinforcing material should be placed, method 300 may return to step 304 and place the binder-reinforcing material in the next selected location, otherwise method 300 may proceed to step 308. Steps 302 and 304 may occur simultaneously until the matrix bit body mold has been filled.

At step 308, the manufacturer may place a universal binder material in the matrix bit body mold. The universal binder material may be placed in the mold after the reinforcement particles and binder-reinforcing material have been packed into the mold. The universal binder material may include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof. A universal binder is a binder which infiltrates the entire bit body and forms the matrix of the resulting metal-matrix composite material. The binder-reinforcing material (e.g., localized binder material), along with the reinforcement particles, is infiltrated and encapsulated by the universal binder. The universal binder material and/or the localized binder material may be selected such that the downhole temperatures during the subterranean operation are less than the melting point of the universal binder material, the localized binder material, and/or any alloy formed between the universal binder material and the localized binder material.

At step 310, the manufacturer may heat the matrix bit body mold and the materials disposed therein via any suitable heating mechanism, including a furnace. When the temperature of the universal binder material exceeds the melting point of the universal binder material, the liquid universal binder material may flow into the reinforcement particles.

At step 312, as the universal binder material infiltrates the reinforcing particles, the universal binder material may additionally react with and/or diffuse into the binder reinforcing material. In some reactions, the reaction between the universal binder material and the binder-reinforcing material may form an intermetallic material composition. In other reactions, the reaction between the universal binder material and the binder-reinforcing material may form a stiff alloy composition.

Figure 4A:
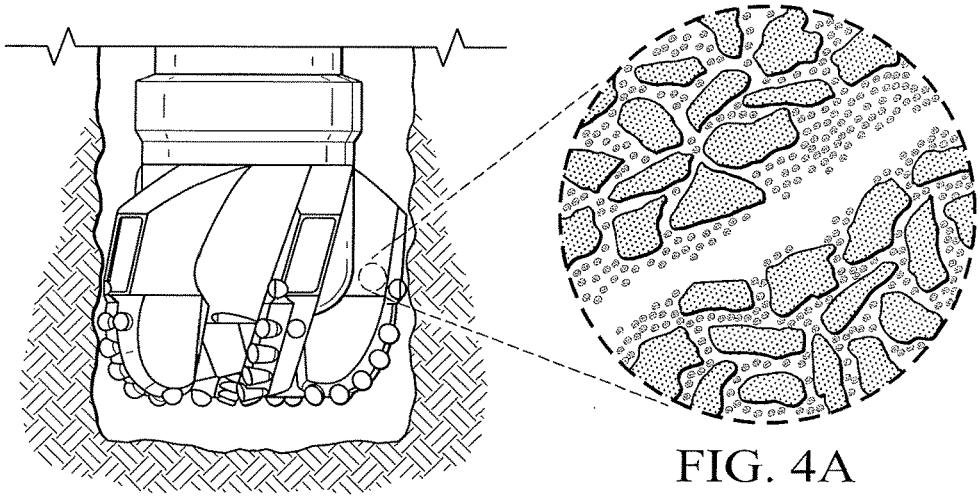
FIGS. 4A-4E are schematic diagrams of a region of the bit body showing at the microscopic level the structure of the reinforced-binder zones resulting from the various different ways of reinforcing the binder zones described herein.

At step 314, the manufacturer may cool the matrix bit body mold, the reinforcing particles, binder-reinforcing material, and the universal binder material. The cooling may occur at a controlled rate. After the cooling process is complete, the mold may be broken away to expose the body of the resulting drill bit. The resulting drill bit body may be subjected to further manufacturing processes to complete the drill bit. FIG. 4A illustrates a microscopic view of small region of the bit body made using the method described with reference to FIG. 3. The shaded regions represent the reinforcing material, which is typically comprised of coarse and fine carbide particles. The white regions in FIG. 4A represent the universal binder, which forms the matrix of the composite material. The vein of binder running through this figure is representative of a binder pool, which may be reinforced according to teachings of this disclosure. FIGS. 4B-E illustrate various methods of reinforced binder formation within the universal binder, and, more particularly, in a binder pool, thereby creating a reinforced binder pool.

The above method identifies one exemplary method of forming the matrix bit body having reinforced binder zones. There are several possible embodiments, based on material selection and design, e.g., melting or not of binder-reinforcing material, formation of intermetallic particles before or during infiltration or during a heat treatment cycle after infiltration, whereby the reinforced binder zones may be formed. The reinforcement structures shown in FIGS. 4B-4E can be located anywhere in the binder pool, which is represented by the region occupied by white void space illustrated in FIG. 4A. Examples include:

(1) A material that forms intermetallic reinforcement particles with the binder via diffusion or reaction in-situ. For example, an intermetallic-forming material may immediately react with the universal binder during the infiltration process to form an intermetallic phase in the location where the intermetallic-forming material was previously located. As an alternate example, an intermetallic-forming material may slowly inter-diffuse with the universal binder, creating an intermetallic phase that potentially has a different shape and/or morphology due to the diffusion transport. The formation of an intermetallic phase via diffusion may occur completely during the infiltration process, or it may be initiated during the infiltration process and continue on during subsequent high-temperature manufacturing processes. Either type of intermetallic formation may occur dependent on the materials that are selected as the universal binder and binder-reinforcing materials, given the different diffusion coefficients, Gibbs free energies of formation, and other material-specific properties associated with material transport and phase formation. In the case of a Cu-based binder, this may include Al, As, Au, Ba, Be, Ca, Cd, Ce, Dy, Er, Eu, Ga, Gd, Ge, Hf, Hg, Ho, I, In, La, Lu, Mg, Nd, O, Pm, Pr, Pt, Pu, S, Sb, Sc, Se, Si, Sm, Sn, Sr, Tb, Te, Th, Ti, Tm, U, Y, Yb, Zn, and Zr. In the case of a Ni-based binder, this may include Al, As, B, Be, Bi, Ca, Cd, Ce, Dy, Er, Eu, Fe, Ga, Gd, Ge, Hf, Hg, Ho, In, La, Mg, Mn, Mo, N, Nb, Nd, O, P, Pr, Pt, Pu, S, Sb, Sc, Se, Si, Sm, Sn, Sr, Ta, Tb, Te, Th, Ti, U, V, W, Y, Yb, Zn, and Zr. In the case of a Mn-based binder, this may include Al, As, Au, B, Bi, C, Co, Cr, Dy, Er, Ga, Gd, Ge, Hf, Hg, Ho, In, Ir, Lu, Mo, N, Nb, Nd, Ni, O, P, Pd, Pm, Pr, Pt, Pu, Re, Rh, Ru, S, Sb, Se, Si, Sm, Sn, Ta, Tb, Te, Th, Ti, Tm, U, V, Y, Zn, and Zr. In the case of a Zn-based binder, this may include Ag, As, Au, Ba, Ca, Ce, Co, Cr, Cu, Dy, Er, Eu, Fe, Gd, Hg, Ho, I, K, Li, Lu, Mg, Mn, Mo, Na, Nb, Nd, Ni, O, P, Pd, Pr, Pt, Pu, Rb, Rh, Ru, S, Sb, Sc, Se, Sr, Tb, Tc, Te, Th, Ti, Tm, U, V, Y, Yb, and Zr. In the case of a Ag-based binder, this may include Al, As, B, Ba, Be, Ca, Cd, Ce, Dy, Er, Eu, Ga, Gd, Hf, Hg, Ho, In, La, Li, Lu, Mg, Na, Nd, P, Pm, Pr, Pt, Pu, S, Sb, Sc, Se, Sm, Sn, Sr, Tb, Te, Th, Ti, Tm, Y, Yb, Zn, and Zr. In the case of an Al-based binder, this may include As, Au, B, Ba, C, Ca, Ce, Co, Cr, Cu, Dy, Er, Eu, Fe, Gd, Hf, Ho, I, Ir, La, Li, Lu, Mg, Mn, Mo, N, Nb, Nd, Ni, O, P, Pd, Pm, Pr, Pt, Pu, Re, Rh, Ru, S, Sb, Sc, Se, Sm, Sr, Ta, Tb, Te, Th, Ti, Tm, U, V, W, Y, Yb, and Zr. In the case of a Au-based binder, this may include Al, Be, Bi, Ca, Cd, Ce, Cs, Cu, Dy, Er, Eu, Ga, Gd, Hf, Hg, Ho, In, K, La, Li, Lu, Mg, Mn, Na, Nb, Nd, Pb, Pd, Pm, Pr, Pu, Rb, Sb, Sc, Se, Sm, Sn, Sr, Ta, Tb, Te, Th, Ti, Tm, U, V, Yb, Zn, and Zr. In the case of a B-based binder, this may include Ag, Al, As, Ba, Be, C, Ca, Ce, Co, Cr, Dy, Er, Eu, Fe, Gd, Hf, Ho, La, Li, Lu, Mg, Mn, Mo, N, Nb, Nd, Ni, Np, Os, Pd, Pm, Pr, Pt, Pu, Re, Rh, Ru, S, Sc, Se, Si, Sm, Sr, Ta, Tb, Tc, Th, Ti, Tm, U, V, W, Y, Yb, and Zr. In the case of a Co-based binder, this may include Al, As, B, Be, Ce, Cr, Dy, Er, Ga, Gd, Ge, Hf, Ho, In, La, Lu, Mg, Mn, Mo, N, Nb, Nd, O, P, Pr, Pt, Pu, S, Sb, Sc, Se, Si, Sm, Sn, Ta, Tb, Te, Th, Ti, U, V, W, Y, Yb, Zn, and Zr. In the case of a Cr-based binder, this may include Al, As, B, Be, C, Co, Ga, Ge, Hf, I, In, Ir, Mn, N, Nb, O, Os, P, Pd, Pt, Re, Rh, Ru, S, Sb, Se, Si, Ta, Tc, Te, Ti, Zn, and Zr. In the case of an Fe-based binder, this may include Al, As, B, Be, C, Ce, Dy, Er, Eu, Ga, Gd, Ge, Hf, Ho, I, Ir, Lu, Mo, N, Nb, Nd, Ni, Np, O, P, Pd, Pm, Pr, Pt, Pu, Re, S, Sb, Sc, Se, Si, Sm, Sn, Ta, Tb, Tc, Te, Th, Ti, Tm, U, V, W, Y, Yb, Zn, and Zr. In the case of an In-based binder, this may include Ag, As, Au, Ba, Bi, Ca, Cd, Ce, Co, Cr, Cs, Cu, Dy, Er, Eu, Gd, Hg, Ho, I, Ir, K, La, Li, Lu, Mg, Mn, N, Na, Nb, Nd, Ni, O, P, Pb, Pd, Pm, Pr, Pt, Pu, Rb, Rh, S, Sb, Sc, Se, Sm, Sn, Sr, Tb, Te, Th, Ti, Tl, Tm, U, Y, Yb, and Zr. In the case of a Mo-based binder, this may include Al, As, B, Be, C, Co, Fe, Ga, Ge, Hf, I, Ir, Mn, N, Ni, O, Os, P, Pt, Re, Rh, Ru, S, Sb, Se, Si, Sn, Tc, Te, U, Zn, and Zr. In the case of a P-based binder, this may include Ag, Al, As, Ba, Cd, Co, Cr, Cu, Fe, Ga, Ge, In, Ir, Mn, Mo, Ni, Os, Pd, Pr, Pt, Rh, Ru, S, Se, Si, Sn, Te, Th, Ti, and Zn. In the case of a Pb-based binder, this may include Au, Ba, Bi, Ca, Ce, Cs, Dy, Eu, Gd, Hg, I, In, K, La, Li, Lu, Mg, Na, O, Pd, Pr, Pt, Pu, Rb, Rh, S, Sc, Se, Sm, Sr, Te, Th, Ti, U, Y, Yb, and Zr. In the case of a Pd-based binder, this may include Al, As, Au, B, Ba, Be, Bi, Ca, Cd, Ce, Cr, Dy, Er, Eu, Fe, Ga, Gd, Ge, Hf, Hg, Ho, In, Li, Lu, Mg, Mn, Na, Nb, Nd, P, Pb, Pr, Pu, S, Sb, Sc, Se, Si, Sm, Sn, Ta, Tb, Te, Th, Ti, Tl, Tm, U, V, W, Y, Yb, Zn, and Zr. In the case of a Si-based binder, this may include As, B, Ba, C, Ca, Ce, Co, Cr, Cu, Dy, Er, Fe, Gd, Hf, Ho, Ir, La, Li, Lu, Mg, Mn, Mo, N, Nb, Nd, Ni, O, Os, P, Pd, Pr, Pt, Pu, Re, Ru, S, Sc, Se, Sm, Sr, Ta, Tb, Te, Th, Ti, Tm, U, V, W, Y, Yb, and Zr. In the case of a Sn-based binder, this may include Ag, As, Au, Ba, Ca, Ce, Co, Cs, Cu, Dy, Er, Eu, Fe, Gd, Hf, Hg, Ho, I, In, K, La, Li, Lu, Mg, Mn, Mo, Na, Nb, Nd, Ni, O, P, Pd, Pr, Pt, Pu, Rb, Rh, Ru, S, Sb, Sc, Se, Sm, Sr, Ta, Tb, Te, Th, Ti, Tl, Tm, U, V, Y, Yb, and Zr. In the case of a W-based binder, this may include Al, B, Be, C, Co, Fe, Ge, Hf, Ir, N, Ni, O, Os, Pd, Re, Rh, S, Si, Sm, Tc, Te, and Zr.

(2) A binder-reinforcing material that utilizes at least two materials to form the intermetallic reinforcement within itself, either in-situ or before loading. In this embodiment the intermetallic reinforcement particle are either refractory through the infiltration process (e.g., preformed) or solidify via diffusion rather than temperature lowering (e.g., in-situ). In the case of a Cu-based binder reinforcing material, this may include Be. In the case of a Ni-based binder reinforcing material, this may include Al, Be, Ca, Ce, Dy, Er, Eu, Ga, Gd, Ge, Hf, Ho, La, Mo, Nb, Nd, O, Pr, Pu, Si, Sm, Ta, Tb, Th, Ti, V, Y, Yb, and Zr. In the case of a Mn-based binder reinforcing material, this may include Al, B, C, Cr, Er, Ga, Hf, Ir, Lu, Mo, N, Nb, O, Pd, Pt, Re, Rh, Ru, S, Se, Si, Ta, Ti, and Tm. In the case of a Zn-based binder reinforcing material, this may include Pd. In the case of an Al-based binder reinforcing material, this may include B, C, Co, Cr, Fe, Hf, Ir, Mn, Mo, N, Nb, Nd, Ni, O, Pd, Pm, Pr, Pt, Pu, Re, Rh, Ru, Sc, Sm, Ta, Th, Ti, U, V, W, and Zr. In the case of a Au-based binder reinforcing material, this may include Dy, Er, Gd, Hf, Ho, Lu, Nb, Nd, Pr, Sc, Ta, Tb, Th, Ti, Tm, U, V, and Zr. In the case of a B-based binder reinforcing material, this may include Al, As, Ba, Be, C, Ca, Ce, Co, Cr, Dy, Er, Eu, Fe, Gd, Hf, Ho, La, Li, Lu, Mg, Mn, Mo, N, Nb, Nd, Np, Os, Pm, Pr, Pu, Re, Ru, Sc, Si, Sm, Sr, Ta, Tb, Tc, Th, Ti, Tm, U, V, W, Y, Yb, and Zr. In the case of a Co-based binder reinforcing material, this may include Al, B, Be, Ce, Cr, Dy, Er, Gd, Hf, Ho, La, Lu, Mo, Nb, Nd, O, Pr, Pu, Si, Sm, Ta, Tb, Th, Ti, V, W, Y, Yb, and Zr. In the case of a Cr-based binder reinforcing material, this may include Al, B, Co, Be, C, Ga, Ge, Hf, In, Ir, Mn, N, Nb, O, Os, P, Pt, Re, Rh, Ru, 5, Se, Si, Ta, Tc, Te, Ti, and Zr. In the case of an Fe-based binder reinforcing material, this may include Al, B, Be, Dy, Er, Eu, Gd, Hf, Ho, Lu, Mo, Nb, Nd, O, P, Pt, Re, Sc, Si, Sm, Ta, Tb, Tc, Th, Ti, Tm, V, W, Y, Yb, and Zr. In the case of an In-based binder reinforcing material, this may include Cr, Dy, Er, Gd, Ho, Ir, Lu, Pd, Pt, Sc, Tb, Th, Ti, Tm, Y, and Zr. In the case of a Mo-based binder reinforcing material, this may include Al, As, B, Be, C, Co, Fe, Ga, Ge, Hf, Ir, Mn, N, Ni, O, Os, P, Pt, Re, Rh, Ru, S, Se, Si, Sn, Tc, Te, and Zr. In the case of a P-based binder reinforcing material, this may include Ba, Cr, Fe, Ga, Ir, Mo, Rh, Ru, Th, and Ti. In the case of a Pb-based binder reinforcing material, this may include Dy, La, Lu, Pd, Pr, Pu, Sc, Th, Ti, U, Y, and Zr. In the case of a Pd-based binder reinforcing material, this may include Al, Ba, Be, Ce, Dy, Er, Eu, Ga, Gd, Hf, Ho, In, Li, Lu, Mg, Mn, Nb, Nd, Pb, Pu, Sc, Sm, Sn, Ta, Tb, Th, Ti, Tl, U, Y, Yb, Zn, and Zr. In the case of a Si-based binder reinforcing material, this may include B, C, Ca, Ce, Co, Cr, Dy, Er, Fe, Gd, Hf, Ho, Ir, La, Lu, Mn, Mo, N, Nb, Nd, Ni, O, Os, Pr, Pu, Re, Ru, Sc, Se, Sm, Ta, Tb, Th, Ti, Tm, U, V, W, Y, Yb, and Zr. In the case of a Sn-based binder reinforcing material, this may include Ce, Dy, Er, Gd, Hf, Ho, La, Mo, Nb, Nd, Pd, Pr, Pt, Pu, Rh, Ru, Sc, Sm, Sr, Tb, Th, Ti, U, V, Y, Yb, and Zr. In the case of a W-based binder reinforcing material, this may include Al, B, Be, C, Co, Fe, Hf, Ir, N, O, Os, Re, Rh, S, Si, Sm, Tc, and Zr.

(3) An alloy with a miscibility gap, such that the at least one constituent of the alloy may form individual grains and/or particles through melting, diffusion, or non-interaction, which grains and/or particles will not dissolve into at least one other constituent in the alloy. This immiscible alloy may be formed between constituents of the binder reinforcing material or through interaction between constituents of the universal binder and binder reinforcing material and will become part of the composite body. In the case of a Cu-based immiscible alloy, this may include Ag, B, Bi, C, Co, Cr, Cs, Fe, Ir, Li, Mn, Mo, Na, Nb, Os, Pb, Re, Rh, Ru, Ta, Tc, Tl, V, and W. In the case of a Ni-based immiscible alloy, this may include Ag, Au, Ba, C, Li, Pb, and Tl. In the case of a Mn-based immiscible alloy, this may include Ag, Ba, Ca, Cd, Ce, Cu, Eu, La, Li, Mg, Pb, Sr, Tl, and Yb. In the case of a Zn-based immiscible alloy, this may include Al, B, Be, Bi, Ga, Ge, In, Pb, Si, Sm, Sn, and Tl. In the case of a Ag-based immiscible alloy, this may include Bi, C, Co, Cr, Cu, Fe, Ge, Ir, Mn, Mo, Ni, Os, Pb, Re, Si, Tl, U, V, and W. In the case of an Al-based immiscible alloy, this may include Be, Bi, Cd, Ga, Ge, Hg, In, K, Na, Pb, Si, Sn, Tl, and Zn. In the case of a Au-based immiscible alloy, this may include As, B, C, Co, Cr, Fe, Ge, Mo, Ni, P, Pt, Rh, Ru, S, Si, Tl, and W. In the case of a B-based immiscible alloy, this may include Au, Bi, Cd, Cu, Ga, Ge, Hg, In, Pb, Sb, Sn, Te, Tl, and Zn. In the case of a Co-based immiscible alloy, this may include Ag, Au, Bi, C, Cd, Cu, Hg, and Pb. In the case of a Cr-based immiscible alloy, this may include Ag, Au, Bi, Cd, Ce, Cu, Dy, Er, Eu, Gd, Hg, Ho, K, La, Li, Lu, Mg, Na, Nd, Np, Pb, Pm, Pr, Pu, Rb, Sc, Sm, Sn, Tb, Th, Tm, U, W, Y, and Yb. In the case of an Fe-based immiscible alloy, this may include Ag, Al, Ba, Bi, Ca, Cd, Cu, Hg, In, K, La, Li, Mg, Na, Pb, and Sr. In the case of an In-based immiscible alloy, this may include Al, B, Be, Fe, Ga, Ge, Mo, Si, Ta, V, and Zn. In the case of a Mo-based immiscible alloy, this may include Ag, Au, Ba, Bi, Ca, Cd, Ce, Cs, Cu, Dy, Er, Eu, Gd, Hg, Ho, In, K, La, Li, Lu, Mg, Na, Nd, Np, Pb, Pm, Pr, Pu, Rb, Sc, Sm, Sr, Tb, Th, Ti, Tl, Tm, Y, and Yb. In the case of a P-based immiscible alloy, this may include Au, Bi, C, Hg, and Sb. In the case of a Pb-based immiscible alloy, this may include Ag, Al, As, B, C, Cd, Co, Cr, Cu, Fe, Ga, Ge, Mn, Mo, Ni, Sb, Si, W, and Zn. In the case of a Pd-based immiscible alloy, this may include C, Ir, Re, and Rh. In the case of a Si-based immiscible alloy, this may include Ag, Al, Au, Be, Bi, Cd, Ga, Hg, In, Pb, Sb, Sn, Tl, and Zn. In the case of a Sn-based immiscible alloy, this may include Al, B, Be, Cd, Cr, Ga, Ge, Re, Si, and Zn. In the case of a W-based immiscible alloy, this may include Ag, Au, Bi, Ce, Cr, Cu, Dy, Er, Eu, Gd, Hg, Ho, La, Lu, Nd, Pb, Pr, Pu, Sb, Sc, Tb, Th, Ti, Tm, U, Y, and Yb.

(4) Metal-matrix composite materials, such as a carbide, boride, silicide, nitride, or oxide reinforcement in a matrix formed of Ag, Al, Au, B, Co, Cr, Cu, Fe, In, Mn, Mo, Ni, P, Pb, Pd, Si, Sn, W, and Zn, any alloy thereof, and any combination thereof.

Figure 4B:
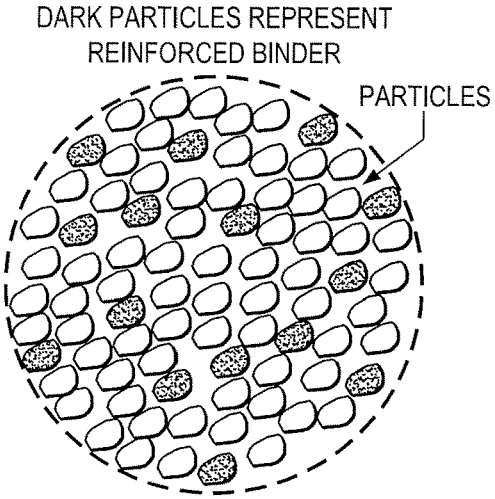
Figure 4C:
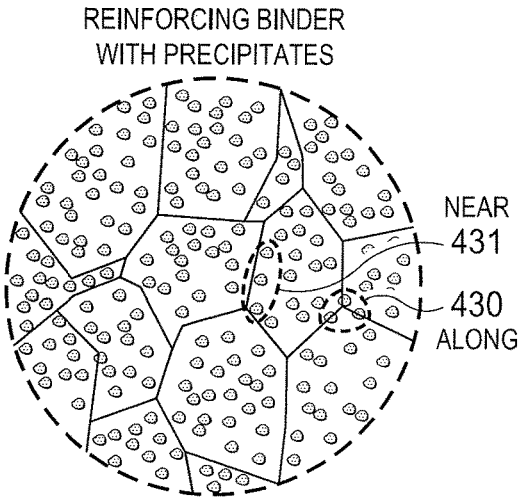
Figure 4D:
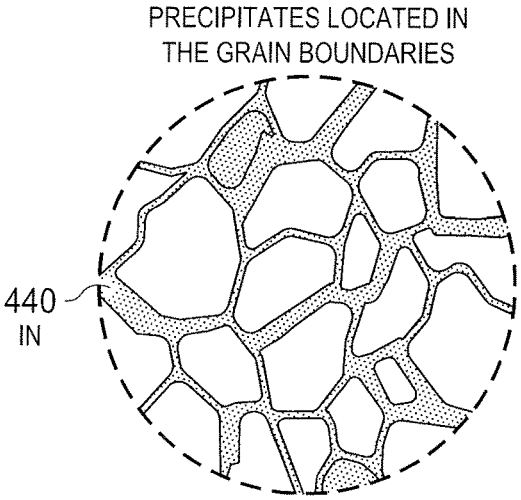
Figure 4E:
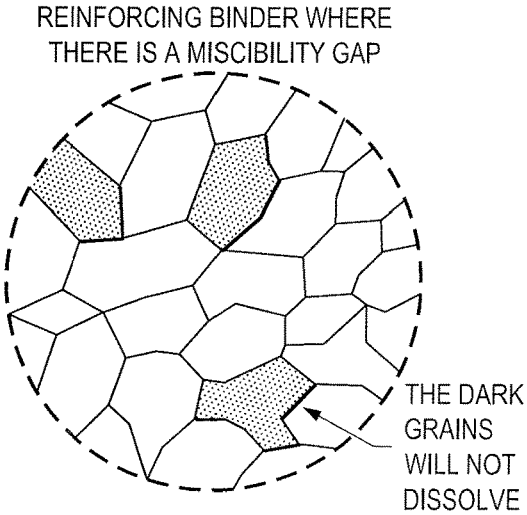

In the case of the alloy with an intermetallic, the binder-reinforcing material can be homogenously dispersed intermetallic phases or particles, as shown in FIG. 4B. Such intermetallic phases or particles may precipitate out throughout the grain structure, as shown in FIG. 4C. Alternatively, intermetallic phases may form and be located in the grain boundaries of the alloy, as shown in FIG. 4D. The location of intermetallic phase formation may depend on localized chemistry or composition. For example, if the binder-reinforcing material exhibits fairly high and even diffusion throughout the binder material, resultant intermetallic phases may precipitate out fairly uniformly throughout the grain structure (see FIG. 4C). If there is slight partitioning of the binder-reinforcing material along the grain boundaries of the binder material, a higher density of resultant intermetallic phases may precipitate out with a higher density along or near the grain boundaries. Finally, heavy partitioning or segregation of the binder-reinforcing material along the grain boundaries of the binder material may lead to formation of intermetallic phases solely or principally along the (former) grain boundaries of the binder material (see FIG. 4D). The intermetallic can be formed in-situ (during infiltration), during manufacturing of the binder-reinforcing material, or during a post-manufacture heat treatment. In the case of a binder-reinforcing material with a miscibility gap, the secondary alloying agent may be refractory or have a lower solubility with the primary alloying agent and/or the infiltrant. The microscopic structure of the binder-reinforcing material mixed with the binder material and which contains a miscibility gap can be seen in FIG. 4E. The dark regions are the grains that will not dissolve. Miscibility gaps, or regions of immiscibility, are wide two-phase regions in phase diagrams that demonstrate the inability of the given materials to mix to form an alloy or second phase. When mixed, immiscible materials, such as water and oil or Cu and W, will form dispersoids or precipitates of the low-concentration material amongst the continuous matrix phase of the high-concentration material. The composition may also be a eutectic where one of the constituents is dissolvable.

The binder-reinforcing material particles can be of any shape and can be mixed in with the reinforcing particles as a substitute for, or in addition to, an existing infiltration aid. The binder-reinforcing material particles may be of any size diameter ranging between, e.g., 1 and 1000 μm. The dispersion can be layered to provide most of the reinforcement in the face of the bit, as described above. Alternatively, the binder-reinforcing material particles can be dispersed through the composite body to provide an appropriate and enhanced compromise between strength and toughness that may be homogenously distributed through the composite material. Furthermore, the binder-reinforcing material particles can be provided in layers or partitions to provide enhanced properties in key locations.

FIG. 5 is a schematic drawing in section with portions broken away showing an example of a mold assembly with layers of the binder-reinforcing material in accordance with the present disclosure positioned near an outer surface of a blade and an apex of an MMC drill bit. Mold assembly 400 may include mold 470, gauge ring 472, and funnel 474 which may be formed of any suitable material, such as graphite. Gauge ring 472 may be threaded to couple with the top of mold 470 and funnel 474 may be threaded to couple with the top of gauge ring 472. Funnel 474 may be used to extend mold assembly 400 to a height based on the size of the drill bit to be manufactured using mold assembly 400. The components of mold assembly 400 may be created using any suitable manufacturing process, such as casting, sintering and/or machining. The shape of mold assembly 400 may have a reverse profile from the exterior features of the drill bit to be formed using mold assembly 400 (the resulting drill bit).

In some cases, various types of temporary displacement materials and/or mold inserts may be installed within mold assembly 400, depending on the configuration of the resulting drill bit. The temporary displacement materials and/or mold inserts may be formed from any suitable material, such as consolidated sand and/or graphite. The temporary displacement materials and/or mold inserts may be used to form voids in the resulting drill bit. For example, consolidated sand may be used to form core 476 and/or fluid flow passage 480. Additionally, mold inserts (not expressly shown) may be placed within mold assembly 400 to form pockets 466 in blade 426. Cutting elements, including cutting elements 128 shown in FIG. 2, may be attached to pockets 466, as described with respect to cutter pockets 166 in FIG. 2.

A generally hollow, cylindrical metal mandrel 478 may be placed within mold assembly 400. The inner diameter of metal mandrel 478 may be larger than the outer diameter of core 476 and the outer diameter of metal mandrel 478 may be smaller than the outer diameter of the resulting drill bit. Metal mandrel 478 may be used to form a portion of the interior of the drill bit.

After displacement materials are placed within mold assembly 400, mold assembly may be filled with the reinforcement particles 490. Reinforcing particles may be selected to provide designed characteristics for the resulting drill bit, such as fracture resistance, toughness, and/or erosion, abrasion, and wear resistance. Reinforcing particles may be any suitable material, such as particles of metals, metal alloys, super alloys, intermetallics, borides, carbides, nitrides, oxides, silicides, ceramics, diamonds, and the like, or any combination thereof. As those of ordinary skill in the art will appreciate, multiple types of reinforcing particles 490 may be used.

During the process of loading the reinforcing particles 490 in mold assembly 400, the binder-reinforcing material 492 may be loaded in specific locations and may be layered and/or mixed with the reinforcing particles 490, as described in step 304 of method 300 shown in FIG. 3. The placement of binder-reinforced material 492 in select regions may provide localized properties in those regions where the material is placed. The binder-reinforcing material 492 may be selected based on the diffusion characteristics of the material. A more focused reaction between universal binder material 494 and the binder-reinforced material 492 may be achieved by selecting materials with low inter-diffusion coefficients and relying upon gravity and alloying of the materials during the infiltration process to produce localized properties in the localized regions, for example, only in the reinforced binder pools.

The binder-reinforcing material 492 may have various sizes and shapes according to the selected localized properties and/or the selected diffusion rates of the binder-reinforced material 492. For example, the binder-reinforcing material 492 may have a geometric shape, may be in foils or plates. In most cases, the binder-reinforcing material 492 will be in a powdered form and may be mixed with the reinforcing particles 490 and placed in the selected areas. In a powdered form, binder-reinforced material 492 may have a size ranging from a micron scale to a millimeter scale.

The binder-reinforcing material 492 may be placed in a variety of locations on the bit body. For example, in FIG. 5, the binder-reinforcing material 492*a* may be placed in layers of substantially the same thickness near the outer surface 497 of junk slot displacement 496 and in the landing area of the resulting drill bit. In addition, the binder-reinforcing material 492*c* may be placed near the outer surface of blade 426. The thickness gradient of the layers of the binder-reinforcing material 492*b* may provide graduated properties throughout the apex region of blade 426. In some configurations, binder-reinforcing material 492 may be shaped to conform to the local geometry of the resulting drill bit. For example, binder-reinforcing material 492*a* may be curved similar to the curvature of junk slot displacement 496.

Once the reinforcing particles 490 and binder-reinforcing material 492 are loaded in mold assembly 400, those components may be packed into mold assembly 400 using any suitable mechanism, such as a series of vibration cycles. The packing process may help to ensure consistent density of the reinforcing particles 490 and provide consistent properties throughout the portions of the resulting drill bit formed of such material.

After the packing of reinforcing particles 490 and binder-reinforcing material, universal binder material 494 may be placed on top of these components, core 476, and/or metal mandrel 478. Universal binder material 494 may include any suitable binder material such as copper, nickel, cobalt, iron, aluminum, molybdenum, chromium, manganese, tin, zinc, lead, silicon, tungsten, boron, phosphorous, gold, silver, palladium, indium, and/or alloys thereof. Universal binder material 494 may be selected such that the downhole temperatures during the subterranean operation are less than the critical temperature or melting point of universal binder material 494, binder-reinforcing material 492, and/or any alloy formed between universal binder material 494 and binder-reinforcing material 492.

Mold assembly 400 and the materials disposed therein may be heated via any suitable heating mechanism, including a furnace. When the temperature of universal binder material 494 exceeds the melting point of universal binder material 494, liquid universal binder material 494 may flow into reinforcing particles 490 towards mold 470. As universal binder material 494 infiltrates the reinforcing particles 490, universal binder material 494 may additionally react with and/or diffuse into or infiltrate binder-reinforcing material 492. In some reactions, the reaction between universal binder material 494 and binder-reinforcing material 492 may form an intermetallic material composition. In other reactions, the reaction between universal binder material 494 and the binder-reinforced material 492 may form a stiff alloy composition. The diffusion between universal binder material 494 and binder-reinforcing material 492 may form a functional gradient of properties between the regions of the drill bit containing infiltrated reinforcing particles and regions of the bit containing binder-reinforced zones.

Once universal binder material 494 has infiltrated reinforcing particles 490 and binder-reinforcing material 492, mold assembly 400 may be removed from the furnace and cooled at a controlled rate. After the cooling process is complete, mold assembly 400 may be broken away to expose the body of the resulting drill bit. The resulting drill bit body may be subjected to further manufacturing processes to complete the drill bit. For example, cutting elements (for example, cutting elements 128 shown in FIG. 2) may be brazed to the drill bit to couple the cutting elements to pockets 466. During the brazing process, reinforced binder zones (shown by reference numeral 492*c* in FIG. 5) may be heated to a sufficient point to cause additional local diffusion, precipitation of phases, formation of intermetallics, and the like, near pockets 466. Furthermore, a post-manufacture heat treatment may enhance certain properties of the binder-reinforced zones, such as increased diffusion and functional grading of properties, precipitation of phases, formation of intermetallics, and the like. Such heat treatment process(es) may occur at any stage after infiltration, such as during cooling, after cooling, or after attachment of cutting elements.

The placement of the binder-reinforcing material shown in FIG. 5 is exemplary only. The placement of the binder-reinforcing material may be based on the regions of the drill bit needing additional toughness, erosion resistance and other desired localized properties. Additionally, the binder-reinforcing material may be alternatively mixed with the reinforcing material throughout the regions where the reinforcing material is placed or throughout the entire bit.

Modeling of an MMC drill bit and/or simulation of a subterranean operation may be used to obtain an analysis of the stresses to which the MMC drill bit may be subjected during the subterranean operation. The stress analysis may be used to select the type of binder-reinforcing material used in the MMC drill bit, as well as the placement of the binder-reinforcing material.

A drill bit having a body formed of a material composition comprising reinforcing particles and reinforced binder zones formed among the reinforcing particles is disclosed. The reinforced binder zones comprise a binder-reinforcing material infiltrated with a universal binder. In any of the embodiments described in this paragraph, the reinforced binder zones may comprise at least two materials that form a refractory intermetallic phase. In any of the embodiments described in this paragraph, the reinforced binder zones may comprise intermetallic reinforcement particles. In any of the embodiments described in this paragraph, the intermetallic reinforcement particles may be located in (illustrated by reference numeral 440 in FIG. 4D), along (illustrated by reference numeral 430 in FIG. 4C), or near (illustrated by reference numeral 431 in FIG. 4C) the grain boundaries of the universal binder. In any of the embodiments described in this paragraph, the reinforced binder zones may comprise a binder-reinforced material based on Cu, Ni, Mn, Zn, Ag, Al, Au, B, Co, Cr, Fe, In, Mo, P, Pb, Pd, Si, Sn, W, or a combination thereof. In any of the embodiments described in this paragraph, the binder-reinforced material based on Cu, Ni, Mn, Zn, Ag, Al, Au, B, Co, Cr, Fe, In, Mo, P, Pb, Pd, Si, Sn, W, or a combination thereof, may further comprise a metal.

In any of the embodiments described in this or the preceding paragraph, the reinforced binder zones may comprise an alloy with a miscibility gap. In any of the embodiments described in this or the preceding paragraph, at least one constituent of the alloy with the miscibility gap may form individual grains and/or particles through melting, diffusion, or non-interaction, which grains or particles will not dissolve into at least one other constituent alloy. In any of the embodiments described in this or the preceding paragraph, the alloy with a miscibility gap may be formed between constituents of the binder-reinforcing material or through interaction between constituents of the universal binder and binder-reinforcing material.

In any of the embodiments described in this or the preceding two paragraphs, the reinforced binder zones may comprise a metal-matrix composite material which comprises a composition selected from the group consisting of a carbide, boride, nitride, silicide, oxide and combinations thereof in a metallic matrix.

A method of forming a drill bit comprising mixing reinforcing particles with a binder-reinforcing material, placing the mixture of reinforcing particles and binder-reinforcing material in a mold used in forming a body of the fixed-cutter bit, placing a universal binder in the mold; and heating the mold is disclosed. The binder-reinforcing material is infiltrated with the universal binder so as to form reinforced binder zones.

In any of the embodiments described in this or the preceding paragraph, the binder-reinforcing material may be preplaced in layers with the reinforcing particles in selected regions of the mold prior to placing the universal binder in the mold. In any of the embodiments described in this or the preceding paragraph, the reinforced binder zones may comprise intermetallic reinforcement particles that are formed via diffusion, chemical reaction in-situ or after solidification, or during a post-infiltration heat treatment. In any of the embodiments described in this or the preceding paragraph, the reinforced binder zones may comprise intermetallic reinforcement particles that are formed during the infiltration process, that are preplaced and blended into the mold, or that are formed during a post-infiltration heat treatment process.

In any of the embodiments described in this or the preceding two paragraphs, the reinforced binder zones may comprise a binder-reinforced material based on Cu, Ni, Mn, Zn, Ag, Al, Au, B, Co, Cr, Fe, In, Mo, P, Pb, Pd, Si, Sn, W, or a combination thereof. In any of the embodiments described in this or the preceding two paragraphs, the binder-reinforced material based on Cu, Ni, Mn, Zn, Ag, Al, Au, B, Co, Cr, Fe, In, Mo, P, Pb, Pd, Si, Sn, W, or a combination thereof, may further comprise a metal. In any of the embodiments described in this or the preceding two paragraphs, the reinforced binder zones may comprise at least two materials that form a refractory intermetallic phase.

In any of the embodiments described in this or the preceding three paragraphs, the reinforced binder zones may comprise an alloy with a miscibility gap, wherein at least one constituent of the alloy with the miscibility gap forms individual grains and/or particles through melting, diffusion, or non-interaction, which grains or particles will not dissolve into at least one other constituent alloy. In any of the embodiments described in this or the preceding three paragraphs, the reinforced binder zones may comprise an alloy with a miscibility gap, which is formed between constituents of the binder-reinforcing material or through interaction between constituents of the universal binder and binder-reinforcing material. In any of the embodiments described in this or the preceding three paragraphs, the reinforced binder zones may comprise a metal-matrix composite material which comprises a composition formed of a carbide, boride, nitride, silicide, oxide and combinations thereof in a metallic matrix.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A drill bit having a body formed of a material composition comprising:

at least one region comprising reinforcing particles infiltrated with a universal binder, and reinforced binder zones formed among reinforcing particles in the at least one region, the reinforced binder zones each comprising a binder-reinforcing material also infiltrated with the universal binder and having a different composition than the reinforcing particles in the at least one region, the reinforced binder zones further comprising an intermetallic material composition or a stiff alloy composition of the universal binder material chemically reacted with the binder-reinforcing material.

2. The drill bit according to claim 1, wherein the intermetallic composition of the reinforced binder zones comprises at least two materials that form a refractory intermetallic phase.

3. The drill bit according to claim 1, wherein the intermetallic composition of the reinforced binder zones comprises intermetallic reinforcement particles.

4. The drill bit according to claim 3, wherein the intermetallic reinforcement particles are precipitated out of a grain structure exclusively in, along, or near the grain boundaries of the universal binder in the reinforced binder zones.

5. The drill bit according to claim 1, wherein the reinforced binder zones comprise a binder-reinforced material based on Cu, Ni, Mn, Zn, Ag, Al, Au, B, Co, Cr, Fe, In, Mo, P, Pb, Pd, Si, Sn, or a combination thereof.

6. The drill bit according to claim 5, wherein the binder-reinforced material based on Cu, Ni, Mn, Zn, Ag, Al, Au, B, Co, Cr, Fe, In, Mo, P, Pb, Pd, Si, Sn, or a combination thereof, further comprises a metal.

7. The drill bit according to claim 1, wherein the reinforced binder zones comprise an alloy with a miscibility gap.

8. The drill bit according to claim 7, wherein at least one constituent of the alloy with the miscibility gap forms individual grains and/or particles through melting, diffusion, or non-interaction, which grains or particles will not dissolve into at least one other constituent alloy.

9. The drill bit according to claim 7, wherein the alloy with a miscibility gap is formed between constituents of the binder-reinforcing material or through interaction between constituents of the universal binder and binder-reinforcing material.

10. The drill bit according to claim 1, wherein the reinforced binder zones are disposed in layers of substantially the same thickness among the at least one region.

11. The drill bit according to claim 1, wherein the reinforced binder zones are located proximate a junk slot formed in the body of the drill bit.

12. The drill bit according to claim 1, wherein the reinforced binder zones are located proximate an apex of a blade formed by the body of the drill bit.

13. The drill bit according to claim 1, wherein the reinforced binder zones are located proximate an outer surface of the blade.

14. The drill bit according to claim 1, wherein each subsequent layer in which the reinforced binder zones are disposed increases in thickness.

15. The drill bit according to claim 14, wherein the reinforced binder zones are disposed in layers that increase in thickness in a direction toward an apex region of a blade formed by the body of the drill bit.

16. The drill bit according to claim 7, wherein the alloy with the miscibility gap is a copper-based alloy or a nickel-based alloy comprising at least one constituent selected from the group consisting of: Ag, Au, B, Ba, Bi, C, Co, Cr, Fe, Mo, Nb, Pb, Re, Ta, Tl, and V.

17. The drill bit according to claim 7, wherein the alloy with the miscibility gap is a copper-based alloy comprising at least one constituent selected from the group consisting of: Ag, B, Bi, C, Co, Cr, Fe, Mo, Nb, Pb, Re, Ta, Tl, and V.

18. The drill bit according to claim 7, wherein the alloy with the miscibility gap is a nickel-based alloy comprising at least one constituent selected from the group consisting of: Ag, Au, Ba, C, Pb, and Tl.

19. The drill bit according to claim 2, wherein the at least two materials that form the refractory intermetallic phase comprise:

at least one of copper and nickel; and at least one constituent selected from the group consisting of: As, Au, Cd, Fe, Hf, Hg, Mn, Mo, Nb, Pt, Sc, Ta, Ti, V, Y, Zn, and Zr.

20. The drill bit according to claim 1, wherein the reinforcing particles comprise tungsten carbide.

* * * * *